US011828166B2

(12) United States Patent
Kruspe et al.

(10) Patent No.: US 11,828,166 B2
(45) Date of Patent: Nov. 28, 2023

(54) ACTIVE MAGNETIC RANGING BY WELLHEAD CURRENT INJECTION

(71) Applicant: Baker Hughes Oilfield Operations LLC, Houston, TX (US)

(72) Inventors: Thomas Kruspe, Wietzendorf (DE); Yuliy Aleksandrovich Dashevskiy, Novosibirsk (RU); Alexey Vladimirovich Bondarenko, Novosibirsk (RU); Nikolay Nikolaevich Velker, Novosibirsk (RU); Alexander Sergeevich Vershinin, Tomsk (RU)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 66 days.

(21) Appl. No.: 17/437,151

(22) PCT Filed: Jun. 10, 2020

(86) PCT No.: PCT/IB2020/000697
§ 371 (c)(1),
(2) Date: Sep. 8, 2021

(87) PCT Pub. No.: WO2021/250438
PCT Pub. Date: Dec. 16, 2021

(65) Prior Publication Data

US 2022/0307368 A1 Sep. 29, 2022

(51) Int. Cl.
*E21B 47/0228* (2012.01)
*E21B 17/00* (2006.01)
*E21B 43/24* (2006.01)

(52) U.S. Cl.
CPC ..... *E21B 47/0228* (2020.05); *E21B 17/003* (2013.01); *E21B 43/2406* (2013.01)

(58) Field of Classification Search
CPC ..... E21B 47/0228; E21B 17/003; E21B 43/2406; E21B 47/0232; E21B 7/04;
(Continued)

(56) References Cited

U.S. PATENT DOCUMENTS 5,218,301 A 6/1993 Kuckes
5,343,152 A 8/1994 Kuckes
(Continued)

FOREIGN PATENT DOCUMENTS

CN 109667550 A 4/2019
EP 3054084 A1 8/2016

OTHER PUBLICATIONS

International Search Report and Written Opinion for priority application, PCT/IB2020/000697, dated Apr. 9, 2021, 11 pgs.

*Primary Examiner* — Brad Harcourt
(74) *Attorney, Agent, or Firm* — Crowe & Dunlevy, P.C.

(57) ABSTRACT

Wellbore ranging methods and systems for active electromagnetic ranging between a pair of conductive tubulars. Methods may include generating a depth-dependent current on one conductive tubular of the pair and a return current on another and thereby causing an injection current to flow into the earth formation by electrically exciting a first conductive tubular of the pair at a first wellhead and a second of the pair at a second wellhead, wherein the return current on the one results from the injection current on the other and is received from the earth formation; making electromagnetic measurements indicative of at least one electromagnetic field resulting from the depth-dependent current in the earth formation; and estimating a relative position of the first conductive tubular with respect to the second tubular using the electromagnetic measurements.

20 Claims, 6 Drawing Sheets

(58) Field of Classification Search
CPC ..... E21B 7/10; E21B 47/024; E21B 47/09; E21B 47/092
See application file for complete search history.

(56) References Cited

U.S. PATENT DOCUMENTS

| | | | | |
|---|---|---|---|---|
| 2009/0260879 | A1* | 10/2009 | Clark | E21B 43/2406 175/45 |
| 2015/0369951 | A1* | 12/2015 | San Martin | E21B 47/024 324/338 |
| 2016/0258275 | A1* | 9/2016 | Wu | G01V 99/005 |
| 2016/0273337 | A1* | 9/2016 | Donderici | E21B 47/0228 |
| 2016/0298444 | A1* | 10/2016 | Donderici | E21B 47/0228 |
| 2021/0363870 | A1* | 11/2021 | Fan | E21B 44/00 |
| 2022/0018244 | A1* | 1/2022 | Bittar | G01V 3/12 |

* cited by examiner

ACTIVE MAGNETIC RANGING BY WELLHEAD CURRENT INJECTION

BACKGROUND OF THE DISCLOSURE

This disclosure relates generally to active electromagnetic wellbore ranging. More particularly, this disclosure relates to apparatus and methods for determining a relative location of a pre-existing wellbore (e.g., a direction and/or distance to a pre-existing wellbore from a tool in a second borehole) and controlling drilling or other downhole operations based on the determination.

To obtain hydrocarbons such as oil and gas, wellbores (also referred to as boreholes) are drilled by rotating a drill bit attached at the distal end of a drilling assembly generally referred to as a "bottom hole assembly" (BHA) or the "drilling assembly." A large portion of the current drilling activity involves drilling highly deviated and substantially horizontal wellbores to increase production (e.g., hydrocarbon production) and/or to withdraw additional fluids from the earth's formations. It should be noted that the terms "wellbore" and "borehole" are used interchangeably in the present document.

Drill pipe, production casing, and many downhole tools are typically made of conductive tubular. It is often desirable to locate the position of one of these types of conductive tubular downhole, such as, for example, by locating the position relative to an other conductive tubular or tool. For example, it is common to drill multiple wellbores in a formation in predetermined relationships to an existing well. More particularly, it is sometimes desirable to drill a number of closely spaced horizontal wellbores for recovery of hydrocarbons from a reservoir. e.g., by drilling a parallel well maintained at a selected distance (typically 5 to 10 meters) with a high accuracy (tolerances of 10 percent or less). This may be contrasted with relief well drilling, another ranging application, where it is desirable to locate a target well and steer the bit closer and closer to an intersection point on the target well. Electromagnetic ranging may be used to determine relative position of a conductive tubular.

Electromagnetic ranging methods generally fall into two categories. A first category, referred to as passive ranging techniques, uses existing magnetic fields. In some cases, this category may utilize a relatively strong magnetism induced in the casing of the pre-existing well by the Earth's magnetic field, or other residual magnetic field of the nearby target well. Passive ranging has many well-known drawbacks.

In the second category, referred to as active ranging, the magnetic field for each measurement associated with a target wellbore is created for each measurement when needed. For example, a source of AC magnetic field and a magnetic sensor may be placed in different wells. The source may be a solenoid placed in a production wellbore or an electric current injected in the production well casing. The magnetic field produced by the current in the casing may be measured in a drilling well that is spaced from the production wellbore. The present disclosure is directed to the second category of wellbore ranging.

SUMMARY OF THE DISCLOSURE

In aspects, the present disclosure is related to methods, systems, and devices for active electromagnetic wellbore ranging. More particularly, this disclosure relates to apparatus and methods for determining a relative location of a pre-existing wellbore (e.g., a direction and/or distance to a pre-existing wellbore from a tool in another borehole) and controlling drilling or other downhole operations based on the determination.

Aspects include wellbore ranging methods for active electromagnetic ranging between a pair of conductive tubulars comprising i) a first conductive tubular in a first borehole intersecting an earth formation and electrically connected to a first wellhead and ii) a second conductive tubular in a second borehole in the earth formation and electrically connected to a second wellhead. The first conductive tubular may be production casing and the second conductive tubular may be part of a drilling assembly.

Methods may include generating a depth-dependent current on one conductive tubular of the pair of conductive tubulars and a return current on another conductive tubular of the pair of conductive tubulars and thereby causing an injection current to flow into the earth formation from the one conductive tubular by: electrically exciting the first conductive tubular at the first wellhead; and electrically exciting the second conductive tubular at the second wellhead. The return current on the other conductive tubular results from the injection current from the one conductive tubular and is received from the earth formation.

Methods may include making electromagnetic measurements at a borehole depth in the second borehole using at least one sensor in the second borehole. The electromagnetic measurements may be indicative of at least one electromagnetic field resulting from the depth-dependent current in the earth formation. Methods may include estimating a relative position of the first conductive tubular with respect to the second tubular using the electromagnetic measurements.

Methods may include at least one of: i) electrically exciting the first conductive tubular at the first wellhead by applying a positive voltage while electrically exciting the second conductive tubular at the second wellhead by applying a negative voltage; and ii) electrically exciting the second conductive tubular at the second wellhead by applying a positive voltage while electrically exciting the first conductive tubular at the first wellhead by applying a negative voltage.

Methods may include at least one of: i) electrically exciting the first conductive tubular at the first wellhead with a power supply while the second conductive tubular at the second wellhead is grounded; and i) electrically exciting the second conductive tubular at the second wellhead with a power supply while the first conductive tubular at the first wellhead is grounded.

Methods may include electrically exciting the first and the second conductive tubular at the first and the second wellhead with an AC power supply.

The electromagnetic measurements may comprise at least one magnetic field measurement and wherein estimating the relative position comprises estimating the relative position using the electric field measurement at the borehole depth and estimated values of the current at the borehole depth. The electromagnetic measurements may comprise at least one magnetic field measurement and at least one electric field measurement.

Methods may include jointly inverting the at least one magnetic field measurement and the at least one electric field measurement. Jointly inverting the at least one magnetic field measurement and the at least one electric field measurement may comprise performing a constrained inversion. For example, an estimated spatial resistivity profile (e.g., a spatial resistivity function or the like) may be employed as a constraint. Estimating the relative position may include estimating the relative position using the electric field measurement at the borehole depth and an estimated value of the current at the borehole depth. Methods may include estimating the value of the current at the borehole depth using a ratio of the electric field measurement and the magnetic field measurement. Methods may include obtaining the estimated value of the current at the borehole depth by estimating at least one value of the current using i) a ratio of the electric field measurement and the magnetic field measurement; and ii) a depth-dependent spatial resistivity value. Methods may include obtaining the estimated value of the current at the borehole depth by estimating at least one value of the current by performing a forward modeling of current as a function of depth. Methods may include estimating the value of the current at the borehole depth by determining a numerical solution to a differential equation including current as a function of depth.

The first conductive tubular may comprise production casing and the second conductive tubular may be part of a drilling assembly. The second conductive tubular may comprise production casing and the first conductive tubular may be part of a drilling assembly. Generating the depth-dependent current may comprise utilizing time synchronization between generating current and making electromagnetic measurements at a borehole depth in the second borehole. The time synchronization may be performed using high precision clocks. The time synchronization may control the making electromagnetic measurements via phase lock loop (PLL) demodulation. The time synchronization may be configured to measure the earth magnetic field while at least one of the injection current and the return current have ceased flowing. This may include wherein the time synchronization is configured to measure the earth magnetic field while both the injection current and the return current have ceased flowing. Time synchronization may be used to measure the earth magnetic field without any current flowing between first and second well.

System embodiments may include a wellbore ranging system for active electromagnetic ranging between a pair of conductive tubulars comprising: i) a first conductive tubular in a first borehole intersecting an earth formation and electrically connected to a first wellhead, and ii) a second conductive tubular in a second borehole in the earth formation and electrically connected to a second wellhead.

Systems may include an electric excitation unit coupled to the first wellhead and the second wellhead and configured to: generate a depth-dependent current on one conductive tubular of the pair and a return current on another conductive tubular of the pair and thereby causing an injection current to flow into the earth formation from the one conductive tubular by: electrically exciting the first conductive tubular at the first wellhead; and electrically exciting the second conductive tubular at the second wellhead, such that the return current on the other conductive tubular results from the injection current from the one conductive tubular and is received from the earth formation.

Systems may include a bottomhole assembly (BHA) configured to be conveyed into a borehole; at least one sensor disposed on the BHA configured to make electromagnetic measurements at a borehole depth in the second borehole using at least one sensor in the second borehole, the electromagnetic measurements indicative of at least one electromagnetic field resulting from the depth-dependent current in the earth formation; and at least one processor configured to estimate a relative position of the first conductive tubular with respect to the second conductive tubular using the electromagnetic measurements.

Estimating the relative position may include estimating the relative position using the electric field measurement at the borehole depth and an estimated value of the current at the borehole depth. Methods may include estimating the value of the current at the borehole depth using a ratio of the electric field measurement and the magnetic field measurement. Methods may include estimating the value of the current at the borehole depth using i) a ratio of the electric field measurement and the magnetic field measurement; and ii) a depth-dependent spatial resistivity value. Methods may include estimating the value of the current at the borehole depth by determining a numerical solution to a differential equation including current as a function of depth.

Methods may include transmitting information about the estimated relative position to a surface location. The information may be transmitted to the surface location by one of: mud pulse telemetry, electromagnetic telemetry, acoustic telemetry, wired drillpipe communication, the wired drill pipe comprising direct electrical transmission, inductive coupling, capacitive coupling or optical transmission. Methods may include sending at least one command to the drilling BHA, in response to the received information about the relative position and/or BHA orientation. Methods may include changing at least one drilling parameter at the surface, or alternatively downhole inside the directional drilling tool by an automated process, in response to the received information about the BHA orientation, the parameter chosen from a group comprising at least: drilling direction, high side, steering vector, steering rib force, weight on bit, drilling fluid flow rate, and drill string rotational speed. Methods may also include at least one of: i) changing the borehole depth of a tool and/or carrier within the borehole; changing acceleration on the tool and/or carrier, including decelerating or stopping the tool and/or carrier. In the case of a BHA in a drilling system, changing the borehole depth may include extending the borehole.

Other embodiments may include a non-transitory computer-readable medium product accessible to at least one processor, the computer readable medium including instructions that enable the at least one processor to estimate a near-bit azimuth of the BHA using an axial component of a magnetic field estimated from a non-axial component of the magnetic field. The computer-readable medium product may include at least one of: (i) a ROM, (ii) an EPROM, (iii) an EEPROM. (iv) a flash memory, and (v) an optical disk.

BRIEF DESCRIPTION OF THE DRAWINGS

For detailed understanding of the present disclosure, references should be made to the following detailed description of specific embodiments, taken in conjunction with the accompanying drawings, in which like elements have been given like numerals, wherein.

DETAILED DESCRIPTION OF THE DISCLOSURE

Figure 1:
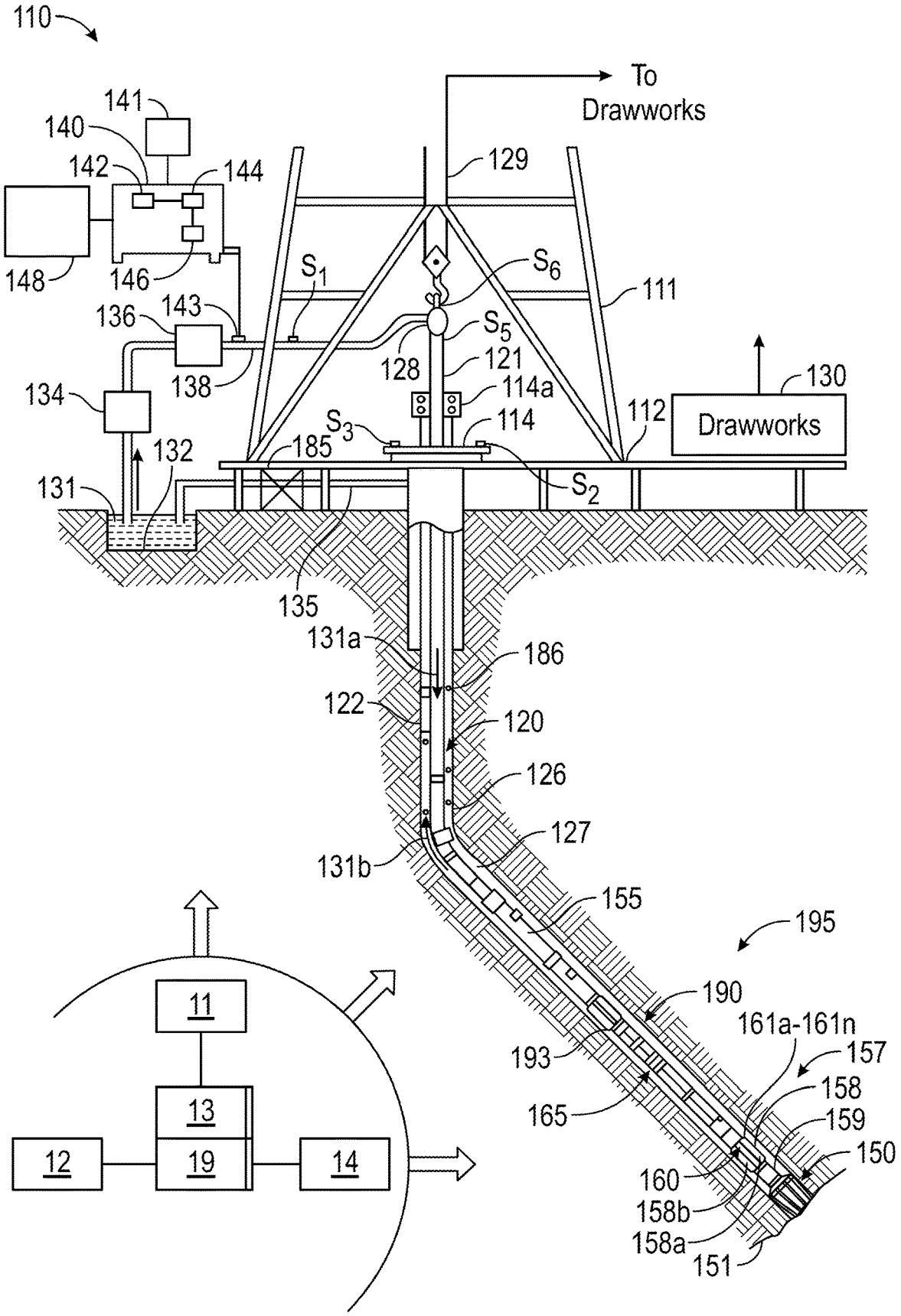
FIG. 1 is a schematic illustration of a drilling system suitable for embodiments in accordance with the present disclosure.

In the process of drilling wells for hydrocarbon production, it is commonly necessary to drill a second well in a predetermined relationship to an existing well. One situation in which accurate drilling is required is in secondary recovery operations. For various reasons, such as low formation pressure or high viscosity of hydrocarbons in the reservoir, production under natural conditions of hydrocarbons may be at uneconomically low rates. In such cases, a second borehole may be drilled to be substantially parallel to the pre-existing borehole. Fluids may then be injected into the formation from the second borehole such that the injected fluid drives the hydrocarbons in the formation towards the producing borehole where it may be recovered.

In a steam assisted gravity drainage (SAGD) system, for example, an injector well is used to inject steam into a formation to heat the oil within the formation to lower the viscosity of the oil so as to produce the liquid resource (e.g., a mixture of oil and water) by a production well. The injector well generally runs horizontally and parallel with the production well. Steam from the injector well heats up the thick oil in the formation, providing the heat that reduces the oil viscosity, effectively mobilizing the oil in the reservoir. After the vapor condenses, the liquid emulsifies with the oil, and the heated oil and liquid water mixture drains down to the production well. A submersible pump may be used to move the oil and water mixture out from the production well. Water and oil go to the surface, the water is separated from the oil, and the water may be reinjected back into the formation by the injector well as steam, for a continuous process. See, for example, U.S. patent application publication No. 2019/0178069 to Stolboushkin.

Electromagnetic wellbore ranging is often used to steer the drill bit in the second borehole so that the resulting second borehole is in a beneficial relationship to the pre-existing borehole. In the case of secondary recovery, for example, it may be highly desirable that the second borehole may run substantially parallel to the pre-existing borehole.

A conventional magnetic ranging process generally involves imparting a strong magnetic field spatially associated with the pre-existing casing being detected and using measurements taken using instruments on a drill string in a second wellbore and resulting from the magnetic field to determine relative position of the second wellbore. This field may be generated via a tool within the pre-existing casing using permanent magnets or an electromagnet system. Alternatively, a tool within the second wellbore may inductively energize the pre-existing casing close to the measurement point, or the pre-existing casing may be inductively energized from the surface via one or more current carrying loops at the surface. These loops may include one or more electrodes placed symmetrically at the surface on either side of the borehole containing the casing. In other examples, an electric current is injected into the production well casing to generate the field, with a diffuse return electrode placed at the surface remotely from the wellhead. See, for example, U.S. Pat. No. 4,372,398 to Kuckes, incorporated herein by reference in its entirety.

Aspects of the present disclosure include wellbore ranging methods for active electromagnetic ranging between i) a first conductive tubular in a first borehole intersecting an earth formation and electrically connected to a first wellhead and ii) a second conductive tubular in a second borehole in the earth formation and electrically connected to a second wellhead. Methods may include generating a depth-dependent current on the first conductive tubular and a return current on the second conductive tubular and thereby causing an injection current to flow into the earth formation from the first conductive tubular. The injection current may flow into the earth formation from the first conductive tubular over a length of the first conductive tubular remote from the wellhead. The injection current is caused by electrically exciting the first conductive tubular at the first wellhead; and electrically exciting the second conductive tubular at the second wellhead. A return current on the second conductive tubular is accepted at the second wellhead. The return current on the second conductive tubular results from the injection current and is received from the earth formation.

Magnetic and electric fields in the formation are dependent upon position of the pre-existing tubular. Methods further include making electromagnetic measurements at a borehole depth in the second borehole using at least one sensor in the second borehole and estimating a relative position of the first conductive tubular with respect to the second tubular using the electromagnetic measurements. The electromagnetic measurements are indicative of at least one electromagnetic field resulting from the depth-dependent current in the earth formation. And thus, measurements are taken with currents on the tubulars to measure a magnetic field and/or an electric field, and these measurements are used to estimate a relative position of the pre-existing tubular with respect to the location with the electromagnetic measurements in accordance with techniques described in further detail below.

The excitation frequency of the current injection may be configured to generate magnetic fields in the formation of sufficient strength to be accurately measured away from the tubular with a high SNR ratio. By using a low-frequency (e.g., less than 20 Hertz) current injection with a value of 10 Amps at the wellhead, a magnetic field of 40 nanotesla or more may result at distances up to 5-10 meters from the conductive tubular. The measurement signal for a field of this size may be significantly larger than signals associated with ambient EM noise in the formation (e.g., approximately 2 nanotesla).

In aspects of the disclosure, distance and direction to the first (e.g., pre-existing) conductive tubular may be estimated from measured values of an electric or magnetic field associated with the excited first (pre-existing) conductive tubular and estimated values of the current at one or more corresponding borehole depths which may influence the fields. A borehole depth-dependent resistivity profile may be used to calculate the induced magnetic field (or electric field). A depth-dependent current may be estimated from a depth-dependent spatial resistivity value $\rho(z)$ and a ratio of electric and magnetic field strengths. The depth-dependent spatial resistivity value $\rho(z)$ may be calculated from a depth-dependent spatial resistivity distribution, or other estimations. The depth-dependent spatial resistivity value $\rho(z)$ may be determined from inverting EM measurements, which may be taken while drilling the pre-existing wellbore. The ratio may be calculated using E and H measurements taken as described above.

The magnetic and electric fields are dependent on both the current and the radial distance from the conductive tubular.

$$H(z)=I(z)/2\pi r \quad (1)$$

$$E(z)=[\rho(z)/2\pi r][dI(z)/dz]. \quad (2)$$

However, depth-dependent ratio E(z)/H(z) does not depend on the distance r to the pre-existing well. Instead, this ratio depends on the formation model and current leakage:

$$E(z)/H(z)=[\rho(z)/I(z)][dI(z)/dz]. \quad (3)$$

Given the depth dependent ratio and the depth-dependent resistivity ρ(z), equation (3) may be treated as a differential equation for current I(z), and solved numerically to obtain the depth-dependent current I(z). The distance r may then be calculated with equation (1) using I(z) and measured H(z).

One advantage of techniques in accordance with the present disclosure is that they allow wellbore access independent ranging. "Wellbore access independent ranging" refers to ranging techniques that allow ranging from the second well without requiring deployment of tools in the pre-existing well. In this way, it is possible to continue to work on the pre-existing well by completing and testing it while drilling the second well.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drilling assembly 190, attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 respectively provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The rate of penetration (ROP) for a given BHA largely depends on the WOB or the thrust force on the drill bit 150 and its rotational speed.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include a variety of other sensors and devices 159 for determining one or more properties of the BHA 190 (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159.

The BHA 190 may include a steering apparatus or tool 158 for steering the drill bit 150 along a desired drilling path. In one aspect, the steering apparatus may include a steering unit 160, having a number of force application members 161*a*-161*n*. The force application members may be mounted directly on the drill string, or they may be at least partially integrated into the drilling motor. In another aspect, the force application members may be mounted on a sleeve, which is rotatable about the center axis of the drill string. The force application members may be activated using electro-mechanical, electro-hydraulic or mud-hydraulic actuators. In yet another embodiment the steering apparatus may include a steering unit 158 having a bent sub and a first steering device 158*a* to orient the bent sub in the wellbore and the second steering device 158*b* to maintain the bent sub along a selected drilling direction. The steering unit 158, 160 may include near-bit inclinometers and magnetometers.

The drilling system 100 may include sensors, circuitry and processing software and algorithms for providing information about desired dynamic drilling parameters relating to the BHA, drill string, the drill bit and downhole equipment such as a drilling motor, steering unit, thrusters, etc. Many current drilling systems, especially for drilling highly deviated and horizontal wellbores, utilize coiled-tubing for conveying the drilling assembly downhole. In such applications a thruster may be deployed in the drill string 190 to provide the required force on the drill bit.

Exemplary sensors include, but are not limited to drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling, and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT, a downhole measurement system, manufactured by BAKER HUGHES INCORPORATED.

The drilling system 100 can include one or more downhole processors 193 at a suitable location such as on the BHA 190. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs.

EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 142 can process the surface measured data, along with the data transmitted from the downhole processor, to evaluate the earth formation and change drilling parameters. While a drill string 120 is shown as a conveyance device for sensors 165, it should be understood that embodiments of the present disclosure may be used in connection with tools conveyed via rigid (e.g. jointed tubular or coiled tubing) as well as non-rigid (e. g. wireline, slickline, e-line, etc.) conveyance systems. The drilling system 100 may include a bottomhole assembly and/or sensors and equipment for implementation of embodiments of the present disclosure on either a drill string or a wireline. A point of novelty of the system illustrated in FIG. 1 is that the surface processor 142 and/or the downhole processor 193 are configured to perform certain methods (discussed below) that are not in prior art.

Figure 2:
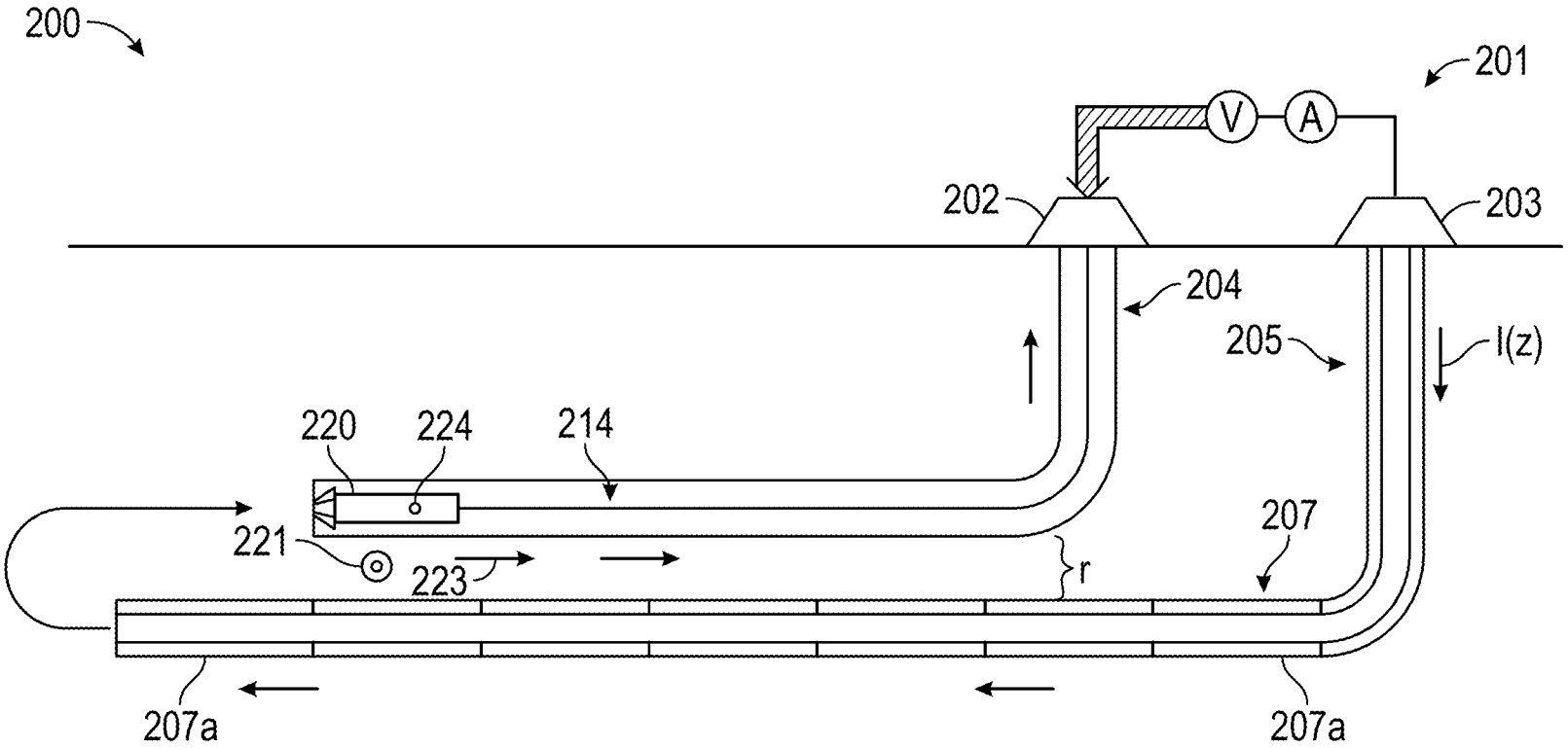
FIG. 2 shows a wellbore ranging system in accordance with embodiments of the present disclosure.

FIG. 2 shows a wellbore ranging system in accordance with embodiments of the present disclosure. Wellbore ranging system 200 includes a target borehole 205 (also referred to herein as a "pre-existing borehole") and a second borehole 204 being drilled substantially parallel with the reference borehole 205. Boreholes 204 and 205 terminate at the surface at wellheads 202 and 203, respectively. The target borehole 205 includes a casing 207 therein that may include one or more casing tubulars 207*a* . . . , 207*n* coupled end-to-end to each other. Casing 207 is made of steel typical to the industry and is therefore a pre-existing conductive tubular.

The second borehole 204 contains a drill string 214 having a tool 220 including one or more sensors 224, such as a magnetometer 224*a*, EM sensor 224*b*, and survey instruments 224*c*. Drill string 214 is also a conductive tubular. EM sensor 224*b* may include a toroidal coil instrument. Electric fields may be estimated using an induced voltage (e.g., as across a toroidal coil). Time-varying magnetic fields associated with time-varying electric fields induce a voltage in a toroidal coil. The electric field at the center of (and perpendicular to the plane of) the toroid may be linearly related to this voltage. See, for example, U.S. Pat. No. 6,373,253 to Lee and Lee. K. H. High-Frequency Electric Field Measurement Using a Toroidal Antenna (1997), which are incorporated herein by reference in their entirety. The magnetometer 224*a* may be implemented as a 3-axis magnetometer, or as various single axis magnetometers aligned along orthogonal directions of a coordination system of the drill string 214. The working principle of the magnetometers could be flux-gate, AMR-magnetometer. GMR-magnetometer, a Hall magnetometer, search-coil or rotating coil magnetometer. An exemplary coordinate system includes axes X, Y and Z, wherein the Z direction is along the longitudinal axis of the drill string 214 proximate the drill bit 218 and X and Y directions are in a plane transverse to the longitudinal axis of the drill string 214. Resistivity instrument 224*b* (e.g., a multiple resistivity tool or the like) is likewise configured to measure electrical fields.

A surface electric excitation unit 201 is electrically coupled to wellheads 202 and 203. The surface electric excitation unit 201 is configured to inject current into wellhead 203. The current may be an AC current with a frequency of lower than 20 Hertz. During a positive half-period of the AC waveform, the current may flow along the metallic casing 207 installed in the target borehole 205 (e.g., an injector well) and the drill string 214 in the second borehole 204 (e.g., the production well) to a negative-voltage electrical return at wellhead 202. By driving the current at the wellheads, it is possible to increase the current amplitude to 10 Amperes or more.

While flowing in the well, at least a portion of the current induces a magnetic field (B) 221 detected by the magnetometer 224*a* and an electric field (E) 223 detected by the EM sensor. The magnetic field measurements and the electric field measurements may be combined using Kalman filtering, as described in greater detail below. The magnetometer measurements are influenced by and representative of the magnetic field and also dependent upon the direction and distance of the magnetometer 224*a* from the casing 207. Similarly, the EM sensor measurements are influenced by and representative of the electric field and also dependent upon the direction and distance of the EM sensor from the casing 207. Using at least one forward model, the magnetic measurements may be inverted to estimate the distance and direction from the magnetometer 224*a* to the casing 207. Using at least one forward model, the electrical measurements may be inverted to estimate the distance and direction from the EM sensor 224*b* to the casing 207. Aspects of the present disclosure include novel techniques for this estimation, described below. Embodiments of the disclosure include joint inversion of the magnetic field measurements and the electric field measurements.

Frequency and current from the surface electric excitation unit 201 can be controlled from downhole. Control variables may include estimated electrical impedance values of the formation, casing string, drillstring, and drilling mud column. Control circuitry may be implemented with impedance stop bands for the AC current in the drill string and with frequency stop bands that reduce current leakages near the surface that could provide short circuits. Further, AC injection from the surface may be synchronized to downhole sensor measurement with the use of at least two high-precision clocks (e.g., an atomic clock), one at surface and one in the downhole system, in order to enable synchronized demodulation. The synchronization may comprise a frequency/phase synchronization of the injected AC and a synchronization of a duty-cycle between times when the current is injected versus time periods when the current is not injected at the surface. See, for example, U.S. Pat. No. 8,378,839 to Montgomery or U.S. patent application publication No. 20130057411 to Bell et al, which are incorporated herein by reference in their entirety.

At least one processor (e.g., surface processor 142, downhole processor 193, etc.) may be configured to receive information representative of magnetometer measurements to determine relative location and/or orientation or the magnetometer 212 with respect to casing 207 using the measured magnetic fields. In various aspects, the determined location and/or orientation may then be used to drill the well 202 at a selected relation to the reference borehole 200 such as parallel to the reference borehole 200. See also, U.S. Pat. No. 5,868,210 to Johnson et al, and European Patent 1426552 to Estes et al., which are incorporated herein by reference in their entirety.

Using the forward model(s), the formation is modeled as a conducting space, and values may be calculated for E and H fields and leaked current at a plurality of arbitrary points within that space. The leaked current (and the resulting fields) may be modeled for a particular depth. Commercial software packages such as CST or COMSOL may be used to model the effects of the current. Alternatively, the model may be derived numerically from Maxwell's equations. The model may employ an appropriate spatial resistivity distribution, which may be determined a priori, estimated from similar formations, or the like.

In one joint inversion model in accordance with embodiments of the present disclosure, a magnetic field measured in an adjacent well is estimated without incorporating effects of current flowing in an adjacent formation (e.g., without regard to the geological medium of the surrounding formation). Instead, the magnetic field is modeled by taking into account only the current I(z) which travels along the pipe.

Figure 3:
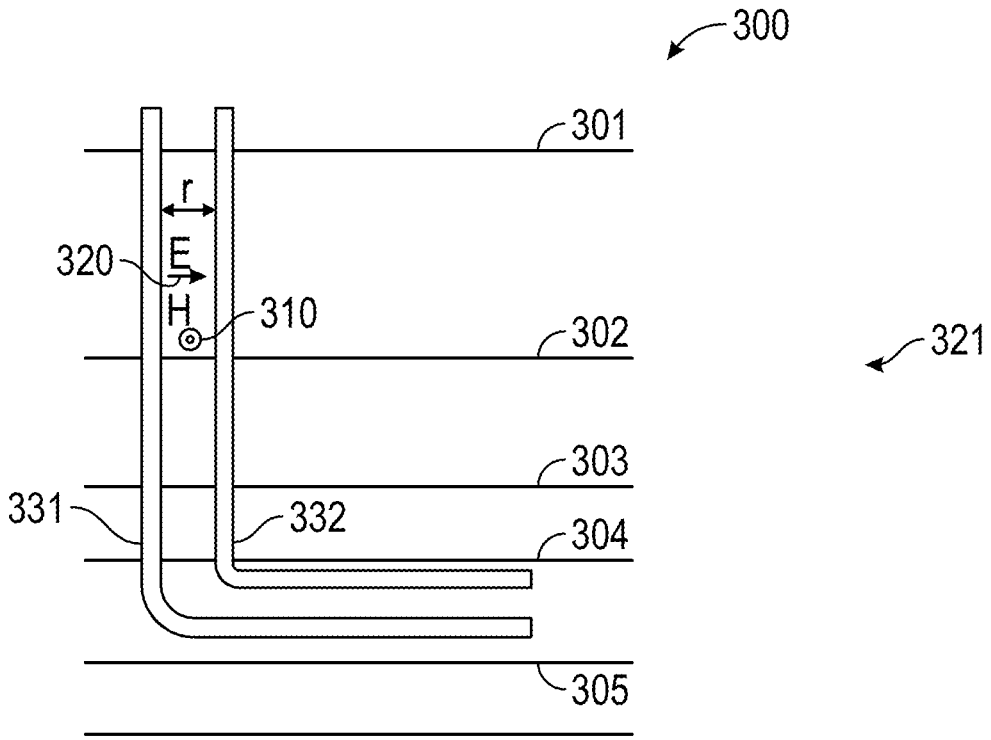
FIG. 3 shows a model of a formation with a first borehole and a second borehole with a current generated on a first conductive tubular in the first borehole in accordance with embodiments of the present disclosure.

FIG. 3 shows a model of a formation with a first borehole and a second borehole with a current generated on a first conductive tubular in the first borehole in accordance with embodiments of the present disclosure. In the model 300, the formation 321 comprises layers 301-305 of various geological media having various resistivity distributions, $\rho(z)_1 \ldots \rho(z)_n$. The current generated on a first conductive tubular in the first borehole 331 results in a magnetic field (H) 310 and an electric field (E) 320 which are measurable from various borehole depths in the second borehole 332, with borehole depth-dependent results for the measurements.

Figure 4A:
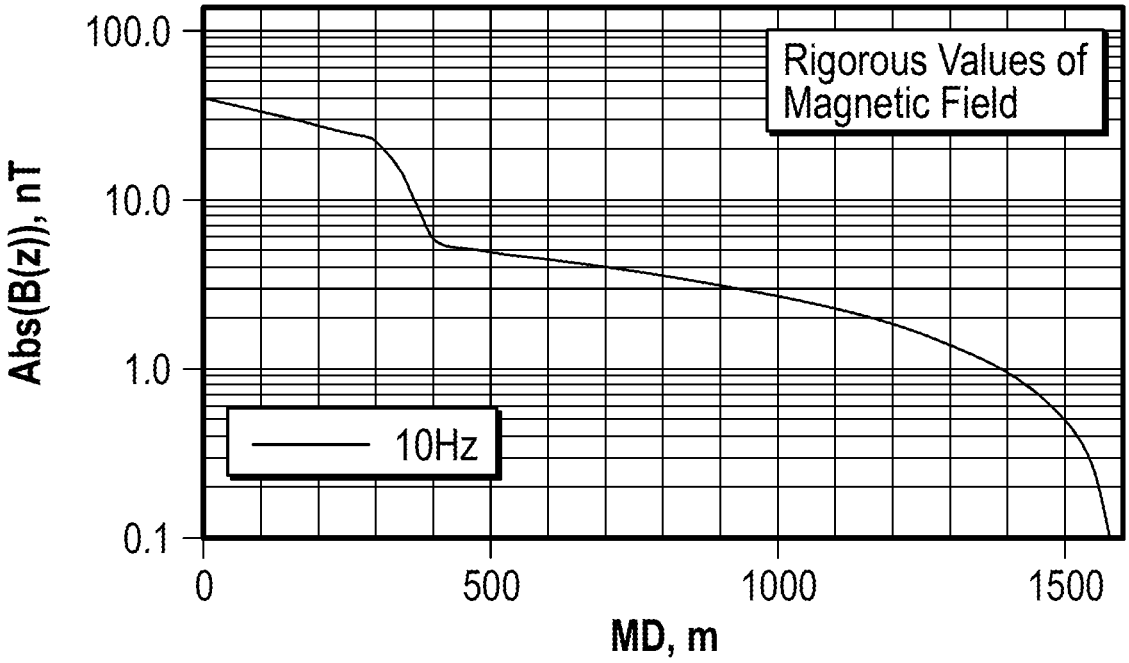
FIGS. 4A & 4B show curves illustrating values with respect to borehole depth, z, of simulated absolute values of the magnetic field and electric field.
Figure 4B:
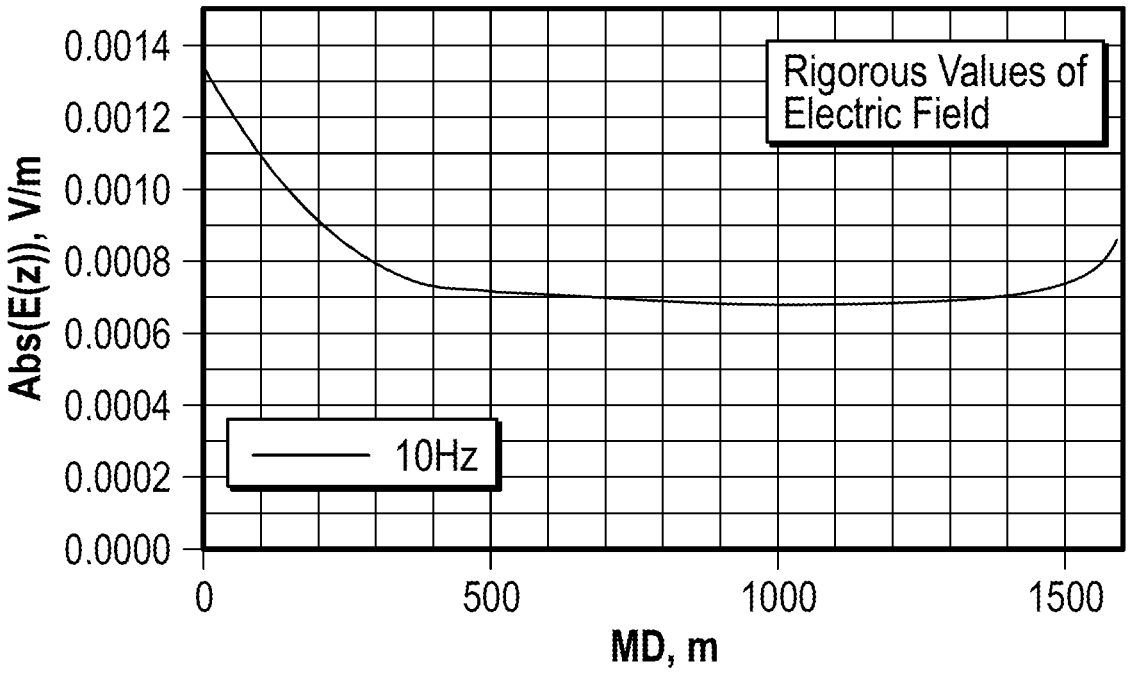

FIGS. 4A & 4B show curves illustrating values with respect to borehole depth, z, of simulated absolute values of the magnetic field (B) (in nanotesla) and electric field (E) (in Volts/meter). The simulation is modeled on a steel casing with outer diameter 7.625 inches; thickness 0.25 inches; resistivity of 1.68 $10^{-7}$ Ohm-m; and magnetic permeability of 100 at a radial distance of 5 meters.

A Bio-Savart approximation of the magnetic field may be calculated as:

$$B(z)_{est}=200I(z)/r.$$

where B is expressed in nanotesla, I is the current in Amperes, z is the borehole depth in meters, and r is the distance to the tubular in meters.

Figure 4C:
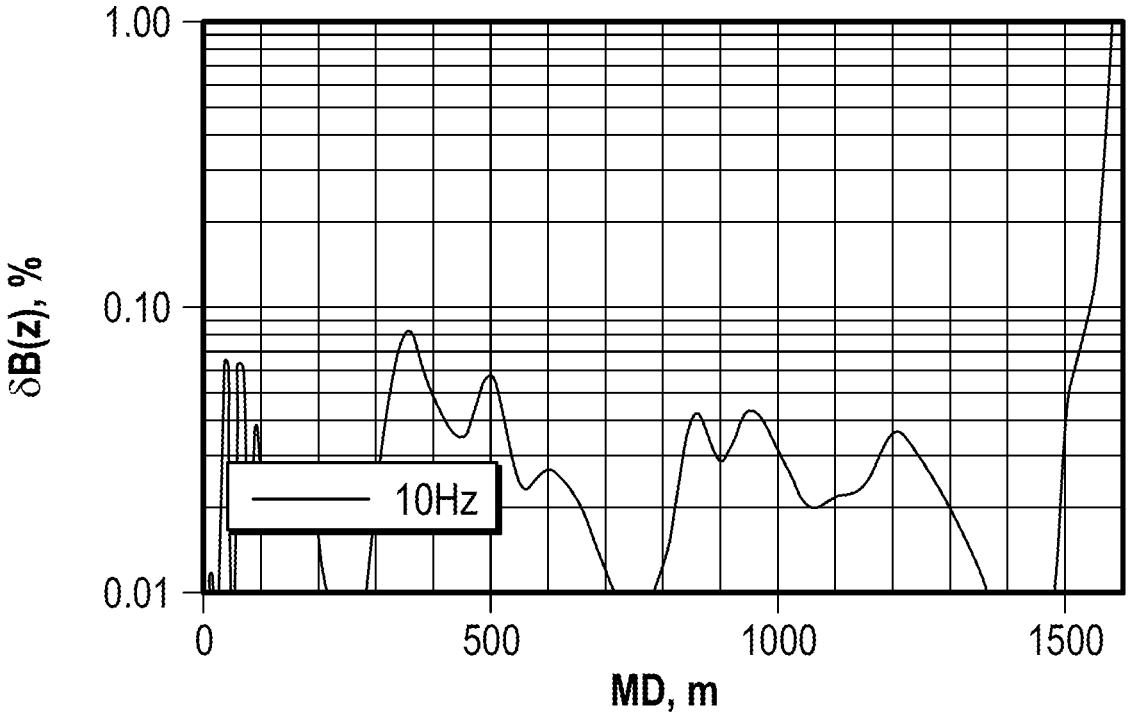
FIG. 4C shows a curve illustrating differences with respect to borehole depth, z, between the simulated absolute values of the magnetic field and the Bio-Savart approximation.

FIG. 4C shows a curve illustrating differences with respect to borehole depth, z, between the simulated absolute values of the magnetic field (B) (in nanotesla) (FIG. 4A) and the Bio-Savart approximation. The accuracy is given as $$(B(z)=|B-B_{est}|/|B|.$$

As is readily apparent from the figure, the accuracy of the Bio-Savart approximation is 0.1 percent or better to a borehole depth of 1500 meters.

Figure 4D:
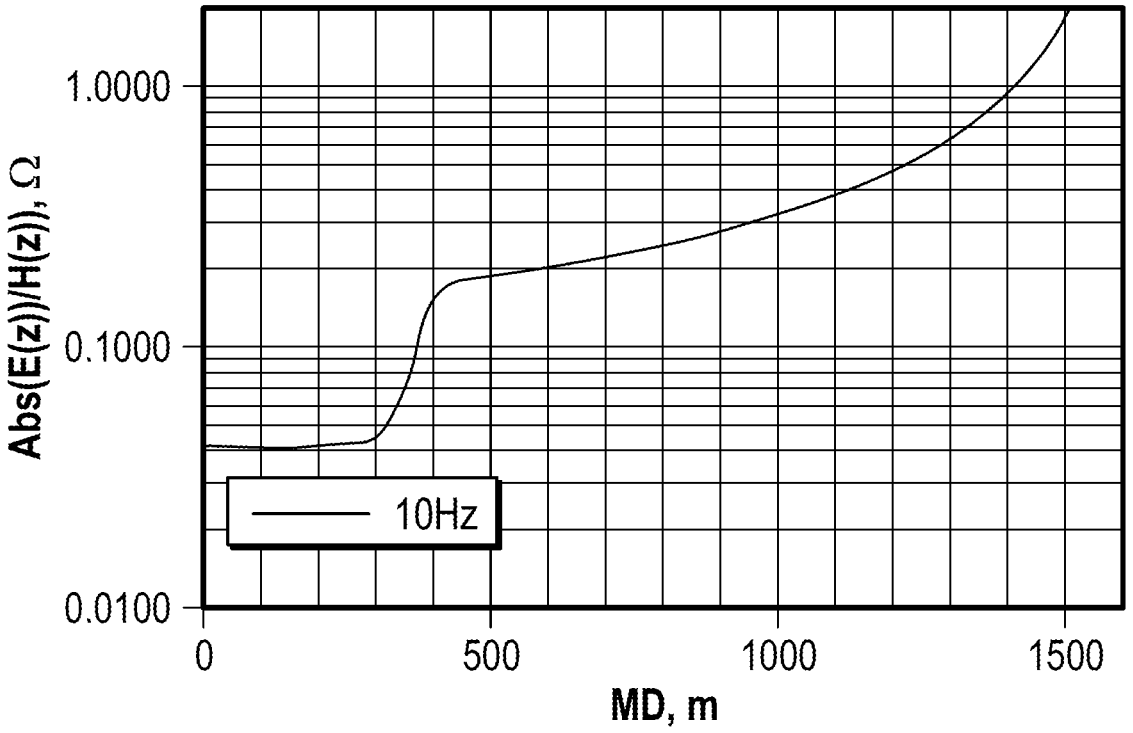
FIG. 4D shows a ratio E(z)/H(z) with respect to borehole depth.

FIG. 4D shows a ratio E(z)/H(z) with respect to borehole depth. As described above, distance and direction to a first conductive tubular may be estimated from measured values of an electric or magnetic field associated with the excited first conductive tubular and estimated values of the current at one or more corresponding borehole depths which may influence the fields. A borehole depth-dependent resistivity profile may be used to calculate the induced magnetic field (or electric field). A depth-dependent current may be estimated from a depth-dependent spatial resistivity value ρ(z) and a ratio of electric and magnetic field strengths. The depth-dependent spatial resistivity value ρ(z) may be calculated from a depth-dependent spatial resistivity distribution, or other estimations. The depth-dependent spatial resistivity value ρ(z) may be determined from inverting EM measurements, which may be taken while drilling the pre-existing wellbore. The ratio may be calculated using E and H measurements taken as described above.

The magnetic and electric fields are dependent on both the current and the radial distance from the conductive tubular. As noted, depth-dependent ratio E(z)/H(z) does not depend on the distance r to the pre-existing well. Instead, this ratio depends on the formation model and current leakage.

Given the depth dependent ratio and the depth-dependent resistivity ρ(z), equation (3) may be treated as a differential equation for current I(z), and solved numerically to obtain the depth-dependent current I(z), such as, for example, by using Finite Element Methods (FEM). The distance r may then be calculated with equation (1) using I(z) and measured H(z).

Electromagnetic measurements in the borehole are synchronized with the current injection to the well in order to remove the influence of the earth's magnetic field. The synchronization between surface injection and downhole system can be achieved by two precise clocks (e.g. atomic clocks). The synchronization of frequency and phase of the injected AC can be utilized for a phase-locked loop (PLL) demodulation of the measurement of magnetic and electric field in the downhole instrument. See, for example, W. Li and J. Meiners. *Introduction to phase-locked loop system modeling*. Analog and Mixed-Signal Products (May 2000), and U.S. Pat. No. 8,810,290 to Cloutier et al, and U.S. Pat. No. 1,990,428 to H. J. J. M. De R. De Bellescize, herein incorporated by reference. A further beneficial aspect of the synchronization is related to a control of frequency of the injected AC. With a predefined scheme the surface system can change the frequency and due to the synchronization the downhole system can react with changing the demodulator frequency. A further aspect of synchronization is related towards synchronizing times when the AC-current is injected at the surface vs. times when the current is not injected at the surface. When current is injected, the downhole system can perform a ranging measurement as described in the invention. During the breaks when no current is injected, the downhole system can determine the background magnetic field and can perform a borehole survey which is required to determine the position of the well in the geologic formation.

Figure 5:
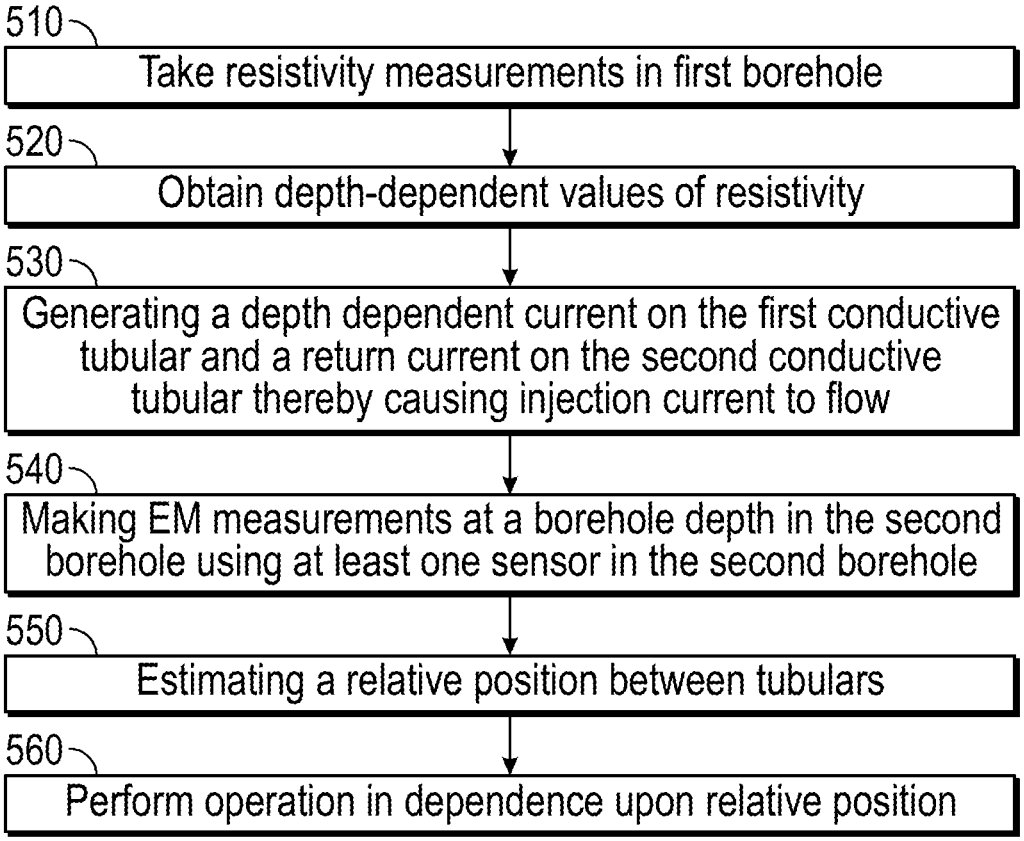
FIG. 5 shows a flow chart illustrating an active electromagnetic ranging method in accordance with embodiments of the present disclosure.

FIG. 5 shows a flow chart illustrating an active electromagnetic ranging method in accordance with embodiments of the present disclosure. In optional step 510, take resistivity measurements in the first borehole. These measurements may be obtained simultaneously with steering and drilling the first borehole, or after. Step 520 comprises obtaining depth dependent values of resistivity, e.g., $r_0(z)$. These may be obtained from the measurements in step 510. Alternatively, estimates of the measurements or the resistivity values may be derived from similar boreholes in the vicinity of the first borehole.

Optional step 530 includes generating a depth-dependent current on the first conductive tubular and a return current on the second conductive tubular and thereby causing an injection current to flow into the earth formation from the first conductive tubular. This may be accomplished by electrically exciting the first conductive tubular at the first wellhead; and electrically exciting the second conductive tubular at the second wellhead. Step 530 may include electrically exciting the first conductive tubular at the first wellhead by applying a positive voltage while electrically exciting the second conductive tubular at the second wellhead by applying a negative voltage. Step 530 may include electrically exciting the first conductive tubular at the first wellhead with a power supply while the second conductive tubular at the second wellhead is grounded. Either of the first or second conductive tubular may comprise a tubing string, a tool string, or a drill string. The excitation may form a circuit including the excitation unit; the tubing string; the tool string; and a portion of the earth formation between an end of the tool string and an end of the tubing string remote from the surface.

Optional step 540 comprises making electromagnetic measurements at a borehole depth in the second borehole using at least one sensor in the second borehole. The electromagnetic measurements are indicative of at least one electromagnetic field resulting from the depth-dependent current in the earth formation. Step 540 may include taking one or more measurements of the magnetic field and/or electric field from the BHA.

Step 550 comprises estimating a relative position of the first conductive tubular with respect to the second tubular using the electromagnetic measurements. Step 550 may include estimating the relative position using an electric field measurement and/or magnetic field measurement at the borehole depth and estimated values of the current at the borehole depth. Step 550 may include jointly inverting the at least one magnetic field measurement and the at least one electric field measurement. Step 550 may include estimating the relative position using the electric field measurement at the borehole depth and an estimated value of the current at the borehole depth. Step 550 may include estimating the value of the current at the borehole depth using a ratio of the electric field measurement and the magnetic field measurement. Step 550 may include estimating the value of the current at the borehole depth using i) a ratio of the electric field measurement and the magnetic field measurement; and ii) a depth-dependent spatial resistivity value. This may be carried out by estimating the value of the current at the borehole depth by determining a numerical solution to a differential equation including current as a function of depth. Optional step 560 comprises performing an operation in the well in dependence upon the relative position.

In other embodiments, all or a portion of the electronics may be located elsewhere (e.g., at the surface, or remotely). To perform the treatments during a single trip, the tool may use a high bandwidth transmission to transmit the information acquired by sensors to the surface for analysis. For instance, a communication line for transmitting the acquired information may be an optical fiber, a metal conductor, or any other suitable signal conducting medium. It should be appreciated that the use of a "high bandwidth" communication line may allow surface personnel to monitor and control operations in "near real-time."

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" are used to distinguish elements and are not used to denote a particular order.

The flow diagrams depicted herein are just an example. There may be many variations to these diagrams or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the spirit and scope of the invention. Accordingly, it is to be understood that the present invention has been described by way of illustrations and not limitation.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. One point of novelty of the systems illustrated in FIGS. 1-3 is that the at least one processor may be configured to perform certain methods (discussed above) that are not in the prior art. A surface control system or downhole control system may be configured to control the tool described above and any incorporated sensors and to estimate a parameter of interest according to methods described herein.

Estimated parameters of interest may be stored (recorded) as information or visually depicted on a display. The parameters of interest may be transmitted before or after storage or display. For example, information may be transmitted to other downhole components or to the surface for storage, display, or further processing. Aspects of the present disclosure relate to modeling a volume of an earth formation using the estimated parameter of interest, such as, for example, by associating estimated parameter values with portions of the volume of interest to which they correspond, or by representing the boundary and the formation in a global coordinate system. The model of the earth formation generated and maintained in aspects of the disclosure may be implemented as a representation of the earth formation stored as information. The information (e.g., data) may also be transmitted, stored on a non-transitory machine-readable medium, and/or rendered (e.g., visually depicted) on a display.

The processing of the measurements by a processor may occur at the tool, the surface, or at a remote location. The data acquisition may be controlled at least in part by the electronics. Implicit in the control and processing of the data is the use of a computer program on a suitable non-transitory machine readable medium that enables the processors to perform the control and processing. The non-transitory machine readable medium may include ROMs. EPROMs, EEPROMs, flash memories and optical disks. The term processor is intended to include devices such as a field programmable gate array (FPGA).

The term "conveyance device" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors. As used above, the term "sub" refers to any structure that is configured to partially enclose, completely enclose, house, or support a device. The term "information" as used above includes any form of information (Analog, digital, EM, printed, etc.). The term "processor" or "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on. Thus, a processor may be configured to perform one or more methods as described herein, and configuration of the processor may include operative connection with resident memory and peripherals for executing programmed instructions. The term "wellhead" refers to the surface termination of a wellbore that incorporates infrastructure for drilling, exploration, or production such as those used for feeding drill pipe, installing casing and production tubing, and installing surface flow-control facilities, and may include wellhead components, e.g., casing valve, tubing head, tubing hanger, and other valves and assorted adapters along with drilling or production tubing. The term "electromagnetic field" refers to an electric field, a magnetic field, or a combination of these.

In some embodiments, estimation of the parameter of interest may involve applying a model. The model may include, but is not limited to, (i) a mathematical equation, (ii) an algorithm. (iii) a database of associated parameters, or a combination thereof.

Returning to FIG. 1, certain embodiments of the present disclosure may be implemented with a hardware environment that includes an information processor 19, an information storage medium 11, an input device 12, processor memory 13, and may include peripheral information storage medium 14. The hardware environment may be in the well, at the rig, or at a remote location. Moreover, the several components of the hardware environment may be distributed among those locations. The input device 12 may be any information reader or user input device, such as data card reader, keyboard. USB port, etc. The information storage medium 11 stores information provided by the sensors. Information storage medium 11 may be any standard computer information storage device, such as a ROM, USB drive, memory stick, hard disk, removable RAM, EPROMs, EAROMs, EEPROM, flash memories, and optical disks or other commonly used memory storage system known to one of ordinary skill in the art including Internet based storage.

Information storage medium 11 may store a program that when executed causes information processor 19 to execute the disclosed method. Information storage medium 11 may also store the formation information provided by the user, or the formation information may be stored in a peripheral information storage medium 14, which may be any standard computer information storage device, such as a USB drive, memory stick, hard disk, removable RAM, or other commonly used memory storage system known to one of ordinary skill in the art including Internet based storage. Information processor 19 may be any form of computer or mathematical processing hardware, including Internet based hardware. When the program is loaded from information storage medium 11 into processor memory 13 (e.g. computer RAM), the program, when executed, causes information processor 19 to retrieve sensor information from either information storage medium 12 or peripheral information storage medium 14 and process the information to estimate a parameter of interest. Information processor 19 may be located on the surface or downhole.

Another application of the techniques of the present disclosure may be when a blowout occurs in the existing well; two approaches may be taken to control the blowout. One method is to use explosives at the surface and snuff out the fire in the burning well. This procedure is fraught with danger and requires prompt control of hydrocarbons flow in the well. The second method is to drill a second borehole to intersect the blowout well and pump drilling mud into the blowout well. This is not a trivial matter. An error of half a degree can result in a deviation of close to 90 feet at a depth of 10,000 feet. A typical borehole is about 12 inches in diameter, a miniscule target compared to the potential error zone.

The following US patents reflect some of the techniques proposed and used for magnetic ranging: U.S. Pat. No. 4,323,848 to Kuckes; U.S. Pat. No. 4,372,398 to Kuckes; U.S. Pat. No. 4,443,762 to Kuckes; U.S. Pat. No. 4,529,939 to Kuckes; U.S. Pat. No. 4,700,142 to Kuckes; U.S. Pat. No. 4,791,373 to Kuckes; U.S. Pat. No. 4,845,434 to Kuckes; U.S. Pat. No. 5,074,365 to Kuckes; U.S. Pat. No. 5,218,301 to Kuckes; U.S. Pat. No. 5,305,212 to Kuckes; U.S. Pat. No. 5,343,152 to Kuckes U.S. Pat. No. 5,485,089 to Kuckes; U.S. Pat. No. 5,512,830 to Kuckes; U.S. Pat. No. 5,513,710 to Kuckes; U.S. Pat. No. 5,515,931 to Kuckes; U.S. Pat. No.

5,675,488 to McElhinney; U.S. Pat. No. 5,725,059 to Kuckes et al.; U.S. Pat. No. 5,923,170 to Kuckes; U.S. Pat. No. 5,657,826 to Kuckes; U.S. Pat. No. 6,937,023 to McElhinney; and U.S. Pat. No. 6,985,814 to McElhinney; each is hereby incorporated by reference herein in their entirety.

While the foregoing disclosure is directed to the one mode embodiments of the disclosure, various modifications will be apparent to those skilled in the art. It is intended that all variations be embraced by the foregoing disclosure.

What is claimed is:

1. A wellbore ranging method for active electromagnetic ranging between a pair of conductive tubulars comprising: i) a first conductive tubular in a first borehole intersecting an earth formation and electrically connected to a first wellhead and ii) a second conductive tubular in a second borehole in the earth formation and electrically connected to a second wellhead, the method comprising:

generating a depth-dependent current on one conductive tubular of the pair of conductive tubulars and a return current on an other conductive tubular of the pair of conductive tubulars and thereby causing an injection current to flow into the earth formation from the one conductive tubular by:

electrically exciting the first conductive tubular at the first wellhead; and electrically exciting the second conductive tubular at the second wellhead;

wherein the return current on the other conductive tubular results from the injection current from the one conductive tubular and is received from the earth formation;

making an electric field measurement at a borehole depth in the second borehole using at least one sensor in the second borehole, the electric field measurement indicative of an electric field resulting from exciting the first conductive tubular and the second conductive tubular electrically; and estimating a relative position of the first conductive tubular with respect to the second conductive tubular using the electric field measurement;

wherein the relative position is estimated using an estimated value of the depth-dependent current at the borehole depth.

2. The method of claim 1, further comprising at least one of: i) electrically exciting the first conductive tubular at the first wellhead by applying a positive voltage while electrically exciting the second conductive tubular at the second wellhead by applying a negative voltage; and ii) electrically exciting the second conductive tubular at the second wellhead by applying a positive voltage while electrically exciting the first conductive tubular at the first wellhead by applying a negative voltage.

3. The method of claim 1, further comprising at least one of: i) electrically exciting the first conductive tubular at the first wellhead with a power supply while the second conductive tubular at the second wellhead is grounded; and a) electrically exciting the second conductive tubular at the second wellhead with a power supply while the first conductive tubular at the first wellhead is grounded.

4. The method of claim 1, further comprising electrically exciting the first conductive tubular and the second conductive tubular at the first wellhead and the second wellhead with an AC power supply.

5. The method of claim 1, further comprising making a magnetic field measurement and wherein the relative position is estimated using the magnetic field measurement at the borehole depth and the estimated value of the depth-dependent current at the borehole depth.

6. The method of claim 5, further comprising jointly inverting the magnetic field measurement and the electric field measurement.

7. The method of claim 6 wherein jointly inverting the magnetic field measurement and the electric field measurement comprises performing a constrained inversion.

8. The method of claim 5, further comprising estimating the value of the depth-dependent current at the borehole depth using a ratio of the electric field measurement and the magnetic field measurement.

9. The method of claim 1, further comprising obtaining the estimated value of the depth-dependent current at the borehole depth by using a depth-dependent spatial resistivity value.

10. The method of claim 1, further comprising obtaining the estimated value of the depth-dependent current at the borehole depth by performing a forward modeling of current as a function of depth.

11. The method of claim 1, further comprising estimating the value of the depth-dependent current at the borehole depth by determining a numerical solution to a differential equation including current as a function of depth.

12. The method of claim 1 wherein the first conductive tubular comprises production casing and the second conductive tubular is part of a drilling assembly.

13. The method of claim 1 wherein the second conductive tubular comprises production casing and the first conductive tubular is part of a drilling assembly.

14. A wellbore ranging method for active electromagnetic ranging between a pair of conductive tubulars comprising: i) a first conductive tubular in a first borehole intersecting an earth formation and electrically connected to a first wellhead and ii) a second conductive tubular in a second borehole in the earth formation and electrically connected to a second wellhead, the method comprising:

generating a depth-dependent current on one conductive tubular of the pair of conductive tubulars and a return current on an other conductive tubular of the pair of conductive tubulars and thereby causing an injection current to flow into the earth formation from the one conductive tubular by:

electrically exciting the first conductive tubular at the first wellhead; and electrically exciting the second conductive tubular at the second wellhead;

wherein the return current on the other conductive tubular results from the injection current from the one conductive tubular and is received from the earth formation;

making an electromagnetic measurement at a borehole depth in the second borehole using at least one sensor in the second borehole, the electromagnetic measurement indicative an electromagnetic field resulting from exciting the first conductive tubular and the second conductive tubular electrically; and estimating a relative position of the first conductive tubular with respect to the second conductive tubular using the electromagnetic measurement;

wherein generating the depth-dependent current comprises utilizing time synchronization between the generating of the depth-dependent current and making the electromagnetic measurement at the borehole depth in the second borehole.

15. The method of claim 14 wherein the time synchronization is performed using high precision clocks.

16. The method of claim 14 wherein the time synchronization controls the making of the electromagnetic measurement via phase lock loop (PLL) demodulation.

17. The method of claim 14 wherein the time synchronization is used to measure a magnetic field of the earth while at least one of the injection current and the return current have ceased flowing.

18. A wellbore ranging system for active electromagnetic ranging between a pair of conductive tubulars comprising: i) a first conductive tubular in a first borehole intersecting an earth formation and electrically connected to a first wellhead, and ii) a second conductive tubular in a second borehole in the earth formation and electrically connected to a second wellhead, the system comprising:

an electric excitation unit coupled to the first wellhead and the second wellhead and configured to:

generate a depth-dependent current on one conductive tubular of the pair of conductive tubulars and a return current on an other conductive tubular of the pair of conductive tubulars and thereby causing an injection current to flow into the earth formation from the one conductive tubular by:

electrically exciting the first conductive tubular at the first wellhead; and electrically exciting the second conductive tubular at the second wellhead, such that the return current on the other conductive tubular results from the injection current from the one conductive tubular and is received from the earth formation;

a bottomhole assembly (BHA) configured to be conveyed into a borehole;

a first sensor disposed on the BHA configured to make electric field measurements at a borehole depth in the second borehole, the electric field measurements indicative of an electric field resulting from exciting the first conductive tubular and the second conductive tubular electrically; and at least one processor configured to estimate a relative position of the first conductive tubular with respect to the second conductive tubular using the electric field measurements;

wherein the relative position is estimated using an estimated value of the depth-dependent current at the borehole depth.

19. The method of claim 14, wherein the electromagnetic field measurement comprises a magnetic field measurement and an electric field measurement, wherein estimating the relative position includes jointly inverting the magnetic field measurement and the electric field measurement.

20. The method of claim 19, wherein jointly inverting the magnetic field measurement and the electric field measurement comprises performing a constrained inversion.

* * * * *